US007319441B2

(12) United States Patent
Bezal et al.

(10) Patent No.: US 7,319,441 B2
(45) Date of Patent: Jan. 15, 2008

(54) SUPPLY DEVICE FOR ELECTRODES OF A PLASMA DISPLAY PANEL

(75) Inventors: Jean-Raphaël Bezal, Montbonnot (FR); Gérard Morizot, Voiron (FR); Gérard Rilly, St Etienne Crossey (FR)

(73) Assignee: Pioneer Plasma Display Corporation, Kagoshima Prefecture (JP)

( * ) Notice: Subject to any disclaimer, the term of this patent is extended or adjusted under 35 U.S.C. 154(b) by 240 days.

(21) Appl. No.: 10/515,496

(22) PCT Filed: May 23, 2003

(86) PCT No.: PCT/EP03/50195

§ 371 (c)(1),
(2), (4) Date: Sep. 1, 2005

(87) PCT Pub. No.: WO03/102907

PCT Pub. Date: Dec. 11, 2003

(65) Prior Publication Data

US 2006/0097959 A1 May 11, 2006

(30) Foreign Application Priority Data

May 31, 2002 (FR) ..... 02 06672

(51) Int. Cl.
*G09G 3/28* (2006.01)

(52) U.S. Cl. ..... 345/60; 345/62; 345/66; 315/169.4

(58) Field of Classification Search ..... 345/60–69, 345/71–72, 37, 204, 42, 52, 41; 315/169.4, 315/169.3

See application file for complete search history.

(56) References Cited

U.S. PATENT DOCUMENTS

| | | | | |
|---|---|---|---|---|
| 5,786,794 | A | 7/1998 | Kishi et al. | |
| 5,943,030 | A * | 8/1999 | Minamibayashi | 345/60 |
| 6,538,627 | B1 * | 3/2003 | Whang et al. | 345/60 |
| 6,917,351 | B1 * | 7/2005 | Velayudhan et al. | 345/60 |
| 7,053,869 | B2 * | 5/2006 | Choi | 345/60 |
| 7,136,032 | B2 * | 11/2006 | Onozawa et al. | 345/60 |
| 7,242,372 | B2 * | 7/2007 | Onozawa et al. | 345/42 |
| 2002/0041275 | A1 * | 4/2002 | Mccormack | 345/204 |

FOREIGN PATENT DOCUMENTS

EP 1 172 794 A 1/2002

* cited by examiner

*Primary Examiner*—Richard Hjerpe
*Assistant Examiner*—Mansour M. Said
(74) *Attorney, Agent, or Firm*—Sughrue Mion, PLLC

(57) ABSTRACT

Provided is a device for supplying an array of electrodes of a plasma display panel, the device including, for each electrode, a driver having a series of switches and a series of diodes, the common points of which are connected to the electrode. The upper terminal of the series of diodes is connected directly to the output of a sustain generator and the lower terminal is connected to the sustain generator via a power switch. One of the terminals of the series of switches is connected to the output of a negative voltage generator. In periods during which the negative voltage generator applies a negative voltage to the electrodes, the power switch is open in order to avoid a short-circuit via the diode of the sustain generator.

20 Claims, 7 Drawing Sheets

SUPPLY DEVICE FOR ELECTRODES OF A PLASMA DISPLAY PANEL

BACKGROUND OF THE INVENTION

1. Field of the Invention

The invention relates to a periodic voltage pulse generator for driving the electrodes or groups of electrodes of a plasma display panel, these being used both for the address and the sustain phases.

2. Description of the Related Art

An AC plasma display panel (or PDP) with memory effect generally comprises two parallel plates leaving between them a space containing a discharge gas; these plates are provided on their internal faces with arrays of electrodes covered with a dielectric layer:

generally two arrays of intersecting electrodes are used for the address phase, at the intersections of which, in the space between the plates, light discharge regions are defined;

at least two arrays of electrodes being used for sustaining.

In the case of coplanar panels, the two sustain arrays are formed from electrodes placed on the same plate and the general directions of which are parallel; each electrode of a sustain array forms with an electrode of the other sustain array a pair of electrodes defining between them a succession of light discharge regions, generally distributed along a line of pixels of the panel.

In the case of matrix panels, the two sustain arrays are no longer coplanar and are located on different plates.

The light discharge regions form, on the panel, a two-dimensional matrix of points capable of emitting light in order to display the image to be displayed.

In general, at least one of these arrays of electrodes is used both for addressing and for sustaining; the invention relates to a generator for an array of electrodes of this type.

The adjacent discharge regions, at least those emitting different colours, are generally bounded by barrier ribs; these barrier ribs generally serve as spacers between the plates.

The walls of the light discharge regions are in general partially coated with phosphors sensitive to the ultra-violet radiation of the light discharges; adjacent discharge regions are provided with phosphors emitting different primary colours so that the combination of three adjacent regions forms a picture element or pixel.

To display an image, the plasma panel in operation carries out a succession of scans, or sub-scans, of the matrix of dots or discharge regions to be activated or not; each scan or sub-scan generally comprises the following steps:

firstly, a selective addressing step whose purpose is to deposit electrical charges on that portion of the dielectric layer of the discharge regions which is to be activated, by applying at least one voltage pulse between the address electrodes intersecting in these regions; and then a non-selective sustain step during which a succession of voltage pulses is applied between the electrodes of one and the same sustain pair so as to cause a succession of light discharges only in the discharge regions located between these electrodes that have been addressed beforehand.

Some of the scans or sub-scans of the panel may furthermore include other phases, such as erase or priming phases, which involve the application of specific voltage pulses; these pulses generally have specific characteristics, not only as regards the hold voltage (high or low hold) but also as regards the voltage rise and/or fall ramps.

The application of voltage pulses between the electrodes of various arrays of the panel, such as those that have just been described, induces cycles charging and discharging the electrical capacitor that these electrodes form between them; as the sustain steps represent by far the highest number of charging and discharging cycles, it is general practice to use, to generate the sustain pulses, generators based on resonant circuits, allowing the capacitive energy between the electrodes to be recovered and re-injected.

FIG. 1 shows diagrammatically a first example of a sustain pulse generator 2' supplying an electrode $Y_n$ of an array Y of a plasma panel 1, the said electrode facing an adjacent electrode $Y'_n$ belonging to another sustain array of this panel; this generator is an energy recovery generator and is described in the document U.S. Pat. No. 4,707,692 (Higgins); to obtain the sustain voltage pulses, this electrode $Y_n$ is alternately switched to a positive DC sustain voltage $V_S$ and to a DC reference voltage $V_{ref}$ via voltage switches 22' and 23' connected in series, respectively; the DC sustain voltage $V_S$ is greater than the reference voltage $V_{ref}$; since these switches are generally MOSFET-type transistors, they each have, in parallel at their terminals, an intrinsic diode 24' and 25' respectively, oriented so as to be conducting from the common point of these switches to the sustain potential $V_S$ and from the reference potential $V_{ref}$ to the common point of these switches, respectively; a resonant inductor 20', connected between the common point of these switches and the electrode $Y_n$ to be supplied, and a storage capacitor 21', connected between the common point of these switches and the reference potential $V_{ref}$ (or the sustain potential $V_S$), allow the capacitive energy to be recovered and re-injected between each alternation; finally, between the electrode $Y_n$ to be supplied and the sustain voltage $V_S$ on the one hand, and between the electrode $Y_n$ to be supplied and the reference voltage $V_{ref}$ on the other hand, the circuit has voltage clamping means connected in series; these means may be simple diodes 26', 27' oriented so as to be conducting in the same direction as the diodes 24', 25' described above of the voltage switches 22', 23', that is to say respectively from the common point of these clamping means to the sustain potential $V_S$ and from the reference potential $V_{ref}$ to the common point of these clamping means; according to a variant shown by the dotted lines in FIG. 1, these clamping means furthermore include voltage switches 28', 29' in parallel with each clamping diode 26', 27'; these switches 28', 29' make it possible in particular to compensate for the energy recovery and re-injection losses; in practice, they are generally MOSFET transistors and the clamping diodes 26', 27' then correspond to the intrinsic diodes of these transistors; the resonant inductor 20' and the storage capacitor 21' are designed to obtain the resonant mode described in the document U.S. Pat. No. 4,707,692 in conjunction with the capacitor between the electrodes of the panel.

FIG. 2 shows diagrammatically a second example of a sustain pulse generator 2 supplying an electrode $Y_n$ of the same plasma panel 1; this generator is an energy recovery generator and is described in the document U.S. Pat. No. 4,866,349 (Weber); to obtain the sustain voltage pulses, this electrode $Y_n$ is alternately switched to a positive DC sustain voltage $V_S$ and to a DC reference voltage $V_{ref}$ via voltage switches 22 and 23 connected in series, respectively; the DC sustain voltage $V_S$ is, as previously, greater than the reference voltage $V_{ref}$; since these switches are generally MOSFET transistors, they each present, in parallel at their terminals, an intrinsic diode, 24 and 25 respectively, oriented so as to be conducting from the common point of these switches to the sustain potential $V_S$ and from the reference potential $V_{ref}$ to the common point of these switches, respectively; to recover and re-inject the capacitive energy, the generator 2 includes a resonant inductor 20, a transferred-energy switching module 30 and a storage capacitor 21 which are connected in series between, on the one hand, the electrode $Y_n$ to be supplied, which corresponds to the common point of the switches 22, 23, and, on the other hand, the reference potential $V_{ref}$ (or the sustain potential $V_S$); the transferred-energy switching module 30 comprises here two transfer elements in parallel, each element itself comprising a switch and a diode in series, the diode of the first element being oriented so as to be conducting in the opposite direction to the diode of the second element, and the intrinsic diode of the switch of each element being oriented in the opposite direction to the diode in series with this element; as illustrated in FIG. 7 of the abovementioned document U.S. Pat. No. 4,866,349, the sustain generator 2 also includes means for clipping the voltage at the common point of the inductor 20 and of the transferred energy switching module 30 by means of diodes 26, 27; the resonant inductor 20 and the storage capacitor 21 are designed to obtain the resonant mode described in document U.S. Pat. No. 4,866,349 in conjunction with the capacitor between the electrodes of the panel.

FIG. 3 shows three voltage pulse timing diagrams, namely that applied to the electrodes $Y_n$ of the sustain and address array Y, that applied to the electrodes $Y'_n$ of the sustain array Y' and that applied to the electrodes $X_p$ of only an address array X, which intersect the electrodes $Y_n$ of the sustain and address array Y.

These timing diagrams represent a succession of successive phases belonging to the same scan or sub-scan cycle of the plasma panel, namely the priming phase $P_P$, the erase phase $P_E$, the address phase $P_A$ and the sustain phase $P_S$.

The generators 2 and 2' that have just been described are used, in the case of the sustain phase $P_S$ to apply voltage pulses $V_S$ to the electrodes or the groups of electrodes $Y_N$ that serve both for the sustain and for other drive phases of the panel.

The electrodes $Y'_n$ of the array Y' that are used only for the sustaining are generally connected together and then form what is called the "common" array; they are generally supplied by an energy recovery generator of the same type as that which supplies the electrodes $Y_n$ of the array Y, such as that described in FIG. 1 or 2; the entire supply for the electrodes during the sustain phases will be described later with reference to FIG. 7 or FIG. 8; according to the timing diagrams shown in FIG. 3, this generator delivers voltage pulses $V'_S$ in phase opposition to the sustain voltage pulses $V_S$ that supply the electrodes $Y_n$ used both for sustain phase and the address phase.

As regards the driving of the electrodes $Y_n$ of the sustain and address array Y, the method of driving the panel, shown in FIG. 3, comprises the application of voltage pulses that have different values relative to the reference voltage $V_{ref}$:

values always greater than the reference voltage $V_{ref}$, namely as regards the priming voltage $V_P$, as regards the "high" address voltage $V_{AH}$ and as regards the sustain voltage $V_S$;

values close to the reference voltage $V_{ref}$, while still being here greater than or equal to it, namely as regards the erase voltage $V_E$ and as regards the "low" address voltage $V_{AL}$.

The "high" address voltage $V_{AH}$ corresponds to a bias voltage applied simultaneously to all the electrodes $Y_n$ of the sustain and address array Y (except for one electrode) throughout the address phase $P_A$; the "low" address voltage $V_{AL}$ corresponds to a short address pulse applied selectively to an electrode $Y_n$ and which, in possible combination with a voltage pulse $V_D$ applied to the electrodes $X_p$ of the array X of columns, allows selective deposition of the charges only in those discharge regions to be activated that are supplied by this electrode $Y_n$.

FIG. 4 shows diagrammatically a supply device 10 for applying the drive method shown by the timing diagram $V_Y$ shown in FIG. 3 to an electrode $Y_n$ of a sustain and address array Y; this device comprises several generators connected in parallel between this electrode $Y_n$ to be supplied and the reference potential $V_{ref}$:

an energy-recovery sustain pulse generator 2 of the Weber type described above with reference to FIG. 2;

at least one signal generator 3 having a potential above the reference potential $V_{ref}$, in this case a bias generator suitable for applying the potential $V_{AH}>V_{ref}$ during the address phase;

at least one signal generator 4 having a potential close to the reference potential $V_{ref}$, in this case an address pulse generator designed to apply the address potential $V_{AL}$.

To be able to apply the drive method shown by the timing diagram $V_Y$ of FIG. 3 to each of the electrodes $Y_n$ of the sustain and address array Y, with reference to FIGS. 5 and 6, each electrode $Y_n$ of this array is connected to the output of the three generators 2, 3, 4 described above via a line driver 5; each line driver conventionally comprises:

two driver switches 51, 52 in series, the common point of these switches being connected to the electrode $Y_n$ to be supplied, the outermost terminals of this series of switches forming an upper switched terminal and a lower switched terminal;

two driver diodes 53, 54 in series, the common point of these diodes also being connected to the electrode $Y_n$ to be supplied, the outermost terminals of this series of diodes forming an upper power terminal and a lower power terminal.

With reference to FIG. 6, all the upper switched terminals of the various drivers 5' are connected together and form a common upper switched terminal 552; all the lower switched terminals of the various drivers 5 are connected together and form a common lower switched terminal 562; all the upper power terminals of the various drivers 5 are connected together and form a common upper power terminal 551; all the lower power terminals of the various drivers 5 are connected together and form a common lower power terminal 561.

For each driver, each driver diode 53 called the "upper" driver diode is oriented so as to be conducting from the common point with the other diode of the series to the common upper power terminal 551, and each driver diode 54 called the "lower" driver diode is oriented so as to be conducting from the common lower power terminal 552 to this same common point.

During the sustain phases, all or practically all the electrodes must be connected simultaneously to the sustain generator 2 so that the electrical current flowing at the common terminals is very high; since the driver switches 51, 52, which are generally of the MOSFET type, would not withstand such currents, it is highly preferable to prevent these sustain currents from flowing via these switches; during the sustain phases where no switching is in general necessary, the electrodes $Y_n$ of the panel 1 are therefore supplied via the driver diodes 53, 54 designed to withstand the flow of high currents.

To be able to manage the supply for the electrodes differently, depending on whether or not the system is in the sustain phase, several solutions are conventionally used:

in the first solution shown in FIG. 5, each driver has only two input terminals, namely an "upper" input terminal 55 and a "lower" input terminal 56, since the common upper switched terminal 552 and the common upper power terminal 551 are coincident and the common lower switched terminal 562 and the common lower power terminal 561 are also coincident; this simplification of the drivers 5 involves the addition of a power switch 6 between the upper input terminal 55 and the lower input terminal 56, this switch being closed during the sustain phases of the panel so as to be able to supply the electrodes $Y_n$ of the panel 1 via the upper power diode 53 or via the lower power diode 54 depending on the off-cycles of the sustain pulses delivered by the generator 2, the driver switches 51, 52 then being open;

in the second solution, shown in FIG. 6, such a power switch is unnecessary since the supplies for the electrodes, on the one hand via the driver diodes 53, 54 and on the other hand via the driver switches 51, 52 are distinct and separate; the common upper power terminal 551 and the common lower power terminal 561 that are used only during the sustain phases are both connected to the same output terminal of the sustain generator 2; moreover, as previously, the upper switched terminal 552 is connected to the output of the signal generator 3 having a potential above the reference potential $V_{ref}$ and the lower switched terminal 562 is connected to the output of the signal generator 4 having a potential close to the reference potential $V_{ref}$.

FIG. 7 shows diagrammatically the entire device for supplying the electrodes of the plasma panel 1, this comprising:

the device 10 for supplying the electrodes $Y_n$ of the sustain and address array Y described previously in FIG. 5;

a supply generator 11 for the electrodes $Y'_n$ of the sustain array Y'; and a generator 12 for supplying the electrodes $X_p$ of the address array X, this being capable of delivering voltage pulses $V_p$ (see FIG. 3); this generator, known per se, will not be described here in detail.

FIG. 8 shows an alternative embodiment of the device for supplying the electrodes shown in FIG. 7, the essential difference lying in the fact that the same means for recovering the capacitive energy of the generator 2', of the type of those of the generator shown in FIG. 2, are used for supplying the electrodes of both sustain arrays Y and Y'.

In general, to prevent the electrodes $Y_n$ of the sustain and address array Y from being subjected to the pulses of the sustain generator from their supply device during the phases other than the sustain phase, especially the address phase, this sustain generator is, if necessary, stopped during these phases.

Some plasma panel drive methods include the application of voltage pulses having values below the reference voltage $V_{ref}$; in FIG. 9 illustrating an example of such a method, the erase voltage $V_E$ applied during the erase phase $P_E$ and the low address voltage $V_{AL}$ applied during the address phase $P_A$ are below the reference voltage $V_{ref}$ (see the arrows directed upwards ⇑ in the figure); during application of such a voltage as $V_{AL}$ by means of a supply device 10 or 10', as described above, and shown in FIGS. 5 and 6 respectively, there would then be a short-circuit via the intrinsic diode 25 at the terminals of the voltage switch 23 of the energy-recovery sustain pulse generator 2; in the case of the generator 10' shown in FIG. 6, this short-circuit also passes via the lower diodes 52 of the drivers 5'; the generator 2" in FIG. 8 has the same drawbacks.

SUMMARY OF THE INVENTION

The object of the invention is to avoid such a short-circuit using simpler and less expensive means than those used in the prior art.

For this purpose, the subject of the invention is a device for supplying an array of sustain electrodes of a plasma display panel provided with a two-dimensional matrix of discharge cells, comprising:

a sustain pulse generator suitable for generating, between a terminal called the reference terminal and at least one terminal called the supply terminal that can be connected to the said electrodes, positive sustain pulses, provided with a module for recovering or re-injecting by means of a resonant inductor capacitive energy at the rising or falling edges of the said pulses, and which is structured so as to allow the electrical current to flow between the said reference terminal and a supply terminal of the said generator when a negative voltage is applied between this supply terminal and the reference terminal;

at least one generator called a "negative voltage" generator designed to generate a negative voltage between the reference terminal and another terminal called the supply terminal that can be connected to the said electrodes;

for each electrode of the said array, a driver designed to connect on command in particular the supply terminal of the said sustain generator and/or that of at least one negative voltage generator to the said electrode, and itself comprising:

two driver diodes in series, oriented so as to be conducting in the same direction from one terminal of the series, common to all the drivers, called the "lower power" terminal, to the other terminal of the series, also common to all the drivers, called the "upper power" terminal, the common point of these diodes being intended to be connected to the electrode to be supplied;

two driver switches in series, the common point of these switches also being intended to be connected to the electrode to be supplied, the outermost terminals of this series of switches being common to all the drivers, one called the "lower switched" terminal, being connected directly to the supply terminal of the said negative voltage generator and the other common terminal of the series being called the "upper switched" terminal, characterized in that:

the said device includes a power switch between the common upper power terminal of the drivers and their common lower power terminal;

the said supply terminal of the said sustain generator is connected directly and without an intermediate switch to the common upper power terminal of the drivers.

The sustain generator furthermore includes switches that make it possible to control the generation of the pulses and to recover or re-inject the capacitive energy between the electrodes of the panel.

For each driver, and by convention, the diode having one of its terminals corresponding to the upper power terminal is called the "upper diode" and the other diode having one of its terminals corresponding to the lower power terminal is called the "lower diode".

Since the common lower switched terminal of the drivers is connected directly to the supply terminal of the negative voltage generator, when this generator delivers a negative voltage to the electrodes, which can mean that at least one of the lower switches of the drivers is closed, this negative voltage is transferred, where appropriate via the lower diode of these drivers, between the supply terminal and the reference terminal of the sustain generator; as the sustain generator is structured, whatever the state—open or closed—of its switches, in order in this case to let the electrical current flow between its reference terminal and its supply terminal, there would be a short-circuit in the absence of the power switch according to the invention, which must then be open in this case.

The reference terminals of the device are obviously all connected together to the same potential called the "reference" potential; this potential generally corresponds to the earth potential.

The negative voltage generator is generally a generator that generates negative voltage pulses, namely voltage ramps and/or voltage holds having a negative part with respect to the reference potential; in contrast, using a DC voltage generator, it is also possible to generate pulses at the electrodes using the "lower" switches of the drivers.

Most of the plasma panel sustain generators that are provided with a resonant energy recovery inductor are structured so as to let the electrical current flow between their reference terminal and a supply terminal, when the voltage applied between this supply terminal and the reference terminal is negative; in general, this is a diode connected so as to be conducting between this reference terminal and this supply terminal.

Owing to the connection, specific to the invention, of the sustain generator to the common terminals of the drivers, and provided that the power switch is suitably controlled, a short-circuit between the supply terminal of the negative voltage generator and the common reference terminal of the generators, via the diode of the system for recovering/re-injecting the capacitive energy of the sustain generator, may be easily avoided when negative voltages or voltage pulses are being applied.

In the prior art, to avoid the abovementioned short-circuit:

either the supply terminal of the sustain generator was connected to the common lower terminal of the drivers via a specific isolating switch intended to isolate the sustain generator during application of the negative voltages;

or the supply terminal of the sustain generator was connected directly to the common lower terminal of the drivers, but the sustain generator was provided with a specific isolating switch between the reference terminal and its supply terminal, which was intended to isolate the sustain generator during the application of the negative voltages.

The solution forming the subject of the invention is simpler and less expensive to implement than those of the prior art; the power switch serves to prevent the short-circuit via the sustain generator during application of negative voltage or voltage pulses to the electrodes, assuming that it is open during the plasma panel drive phases when a negative voltage is applied to the electrodes supplied by the generator according to the invention; advantageously, this switch has other functions during driving, especially those described above of the prior art, so that implementation of the invention therefore involves no additional component in the supply device, but different connections and a different use of the components of this device; by avoiding a specific isolating switch, the thermal losses relating to this switch are also avoided.

The sustain generator generally includes a diode which is connected so as to be conducting between the reference terminal and the supply terminal of the sustain generator, without a switch in series with this diode between the reference terminal and this supply terminal, which allows the flow of the current between these terminals to be cut off.

It is therefore this diode and this connection that structure the sustain generator so as to allow the electrical current to flow between the reference terminal and this supply terminal when a negative voltage is applied between this supply terminal and the reference terminal.

Unlike certain sustain generators of the prior art, the sustain generator of the device according to the invention does not include an isolating switch that would form, with this diode, a series connection between the reference terminal and this supply terminal of the generator.

This diode, which would be responsible for a short-circuit in the absence of the provisions specific to the invention, may be the intrinsic diode of a switch, especially of the MOSFET type, of the sustain generator.

Preferably, the supply device according to the invention furthermore includes at least one pulse generator called the "positive voltage" pulse generator designed to generate a positive voltage between the reference terminal and a terminal called the supply terminal which is connected to the common upper switched terminal of the series of switches of the drivers.

The positive voltage generator is generally a generator that generates positive voltage pulses, namely voltage ramps and voltage holds that are positive with respect to the reference potential; however, using a DC voltage generator, it is also possible to generate pulses at the electrodes by using the "upper" switches of the drivers.

Preferably, the electrodes of the array that are supplied by the device according to the invention are also used for addressing the cells of the said panel.

The address phase conventionally and generally corresponds to a selective panel drive phase, allowing the electrical charges to be deposited only in the discharge cells of the panel to be activated during the subsequent non-selective sustain phase.

Thus, in practice:

as negative voltage generator, there are for example an erase voltage generator and an address voltage generator;

as positive voltage generator, there are for example a priming voltage generator and a bias voltage generator for biasing during the address phase.

The priming and erase phases are generally triggered just before the address phases.

Preferably, according to a standard configuration of electrode drive element, or "driver":

the common upper power terminal of the drivers is connected to and coincident with the common upper switched terminal; and the common lower power terminal of the drivers is connected to and coincident with the common lower switched terminal.

The subject of the invention is also an image display device comprising a plasma panel, comprising two plates leaving a space between them, the said space containing a discharge gas and being partitioned into cells forming a two-dimensional array, comprising at least a first and a second array of electrodes, each electrode of the first array intersecting each electrode of the second array at a different cell of the panel, characterized in that it includes an electrode supply device according to the invention, and in that the common points of the series of diodes and of the series of switches of the various drivers of this supply device are each connected to a different electrode of one of the said arrays of electrodes; in other words, each output supply terminal of the device according to the invention is connected to one electrode of one of the arrays of the panel to be supplied.

Preferably, the display device includes a third array of electrodes that are designed to form, with each of the electrodes supplied by the said supply device, pairs of parallel electrodes for sustaining plasma discharges in the said cells; this is therefore a plasma panel of the coplanar type.

Preferably, the display device also includes means for controlling the plasma discharges in the cells of the said panel, the said means being designed to generate, by means of the said supply device, selective address phases by depositing electrical charges in pre-selected cells and non-selective sustain phases designed to cause discharges only in the pre-selected cells, and either the electrodes supplied by the supply device are address and sustain electrodes or these electrodes are only sustain electrodes, which therefore are not used for addressing.

Preferably, the drive means are designed:

to generate, especially by means of at least one negative voltage generator of the supply device according to the invention, phases during which the voltage applied to electrodes supplied by this device reaches a value below the reference voltage of the reference terminals; and to open the power switch during the said phases.

The subject of the invention is also a method of driving the display device according to the invention in order to display images by means of a succession of image scans and sub-scans, each sub-scan comprising a sustain phase, during which a potential varying periodically between a reference potential and a positive sustain potential is applied to all of the electrodes supplied by the supply device, and at least one preliminary phase during which a negative potential below the reference potential is applied to the electrodes, characterized in that the power switch is open during application of this negative potential.

Preferably, at least one lower switch of the drivers is closed during application of this negative potential.

It is when at least one of these lower switches of a driver is closed that it is possible to apply the negative potential to at least one electrode corresponding to this driver and that it is useful for the power switch to be open in order to avoid the abovementioned short-circuit via the sustain generator.

To summarize, the electrode supply device according to the invention comprises, for each electrode to be supplied, a driver comprising a series of two switches and a series of two diodes, the common points of which are connected to this electrode; the diodes of the series are all conducting in the same direction, namely from the terminal called the "lower" terminal to the terminal called the "upper" terminal of the series; the upper terminal of the series of diodes is connected directly to the output of a sustain generator and its lower terminal is connected indirectly, namely via a power switch, to this same generator; one of the terminals of the series of switches is connected to the output of a negative voltage generator.

BRIEF DESCRIPTION OF THE DRAWINGS

The invention will be more clearly understood from reading the following. description that is given by way of non-limiting example and with reference to the appended figures in which.

DETAILED DESCRIPTION OF EXEMPLARY EMBODIMENTS OF THE INVENTION

The figures showing timing diagrams have not been drawn to scale so as to show more clearly certain details that would not be so clearly visible if proportions had been respected.

To simplify the description and bring out the differences and advantages afforded by the invention compared with the prior art, identical references are used for the elements that fulfil the same functions.

A device according to the invention for supplying at least one array of electrodes of a plasma display panel will now be described with reference to FIG. 10.

Overall, the image display device comprises:

a conventional plasma panel 1;

generators or devices for supplying each array of electrodes of the panel; and conventional means for driving the plasma discharges in the cells of the panel, these being designed to generate, by means of the generators or devices for supplying the electrodes:

priming phases, erase phases for removing the residues of electrical charges deposited during priming, selective address phases by depositing electrical charges into pre-selected cells of the panel and non-selective sustain phases designed to cause discharges only in the pre-selected cells.

The plasma display panel 1 (not shown) is a conventional coplanar AC panel with memory effect; it conventionally comprises two plates, a front plate and a rear plate, leaving a space between them which contains a discharge gas and is partitioned into cells forming a two-dimensional array; the partitioning of the discharge space is achieved by an array of barrier ribs that also serve as spacers between the plates; the walls of the cells are coated, at least partly, with phosphors emitting different primary colours for displaying the images; the array of barrier ribs is two-dimensional or one-dimensional, in which case only the cells of different primary colours are separated by barrier ribs.

The plasma display panel comprises a first array X, a second array Y and a third array Y' of electrodes, each electrode of the first array X intersecting each electrode of the second array Y at a different cell of the panel; the electrodes $X_p$ called "data" electrodes or "column" electrodes of the first array are on the rear plate; the third array Y' of electrodes is designed to form, with each of the electrodes of the second array Y, pairs of electrodes whose general directions are parallel; these second and third arrays are in this case coplanar and on the front plate; these arrays are designed so that each line of cells of the panel is placed between the electrodes $Y_n$, $Y'_n$ of a pair; all the electrodes of the array Y' are connected together to the same potential so that the array Y' is called "common"; the coplanar arrays are coated with a dielectric coating for providing the memory effect and with a magnesia-based layer for protection and for emitting secondary electrons.

Figure 7:
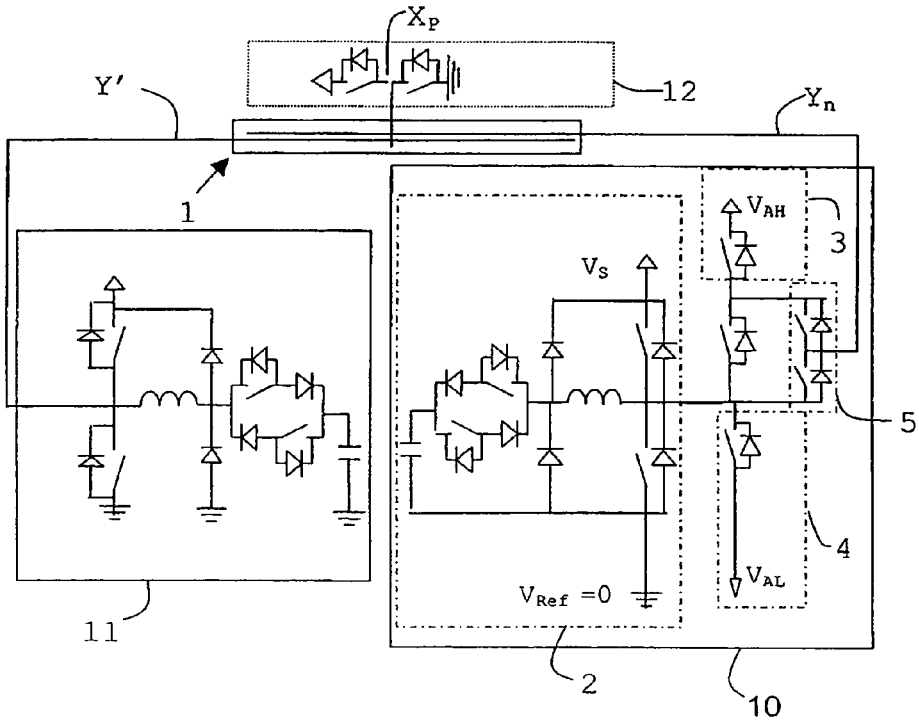
FIGS. 7 and 8, already described, show, very diagrammatically and according to the prior art, a plasma panel together with the supplies for its electrodes, with a sustain generator for energy recovery via the array of electrodes used for the sustain phase, in the case of FIG. 7 and with a single energy recovery sustain generator for the two arrays of electrodes used for the sustain phase, in the case of FIG. 8.
Figure 8:
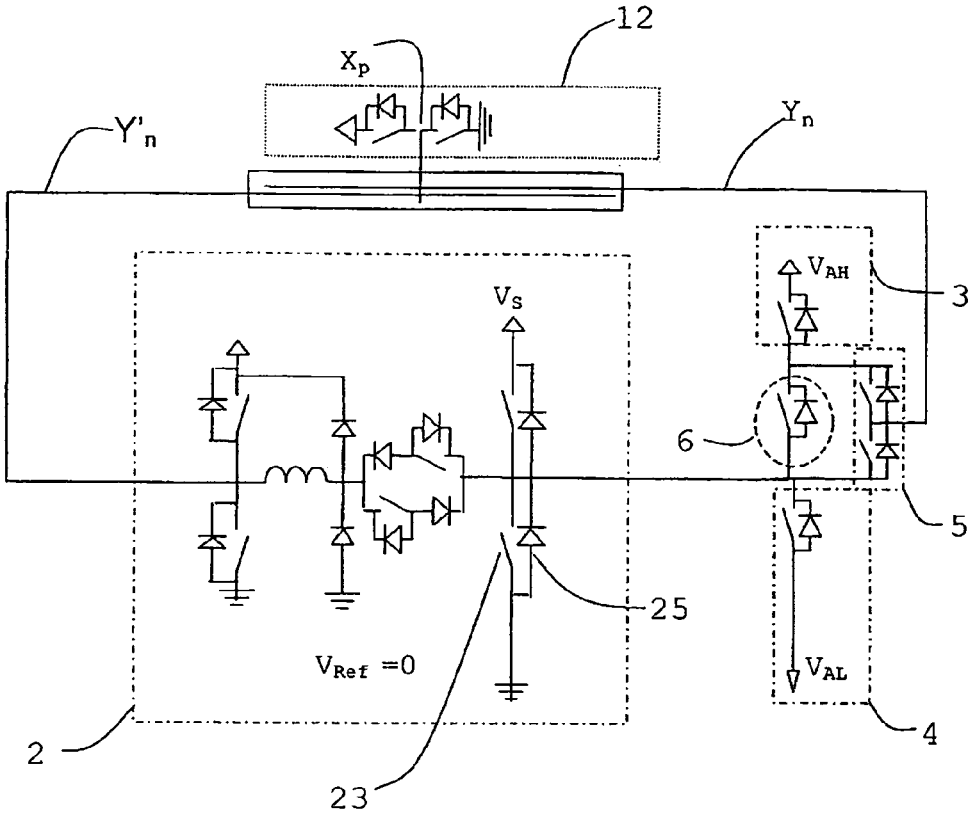

As in the display device already described and shown in FIG. 7, the first array X of data electrodes is supplied by a data generator 12 and the third array Y' of common electrodes is supplied by a conventional common sustain pulse generator 11; these generators, known per se, will not be described in detail.

Figure 2:
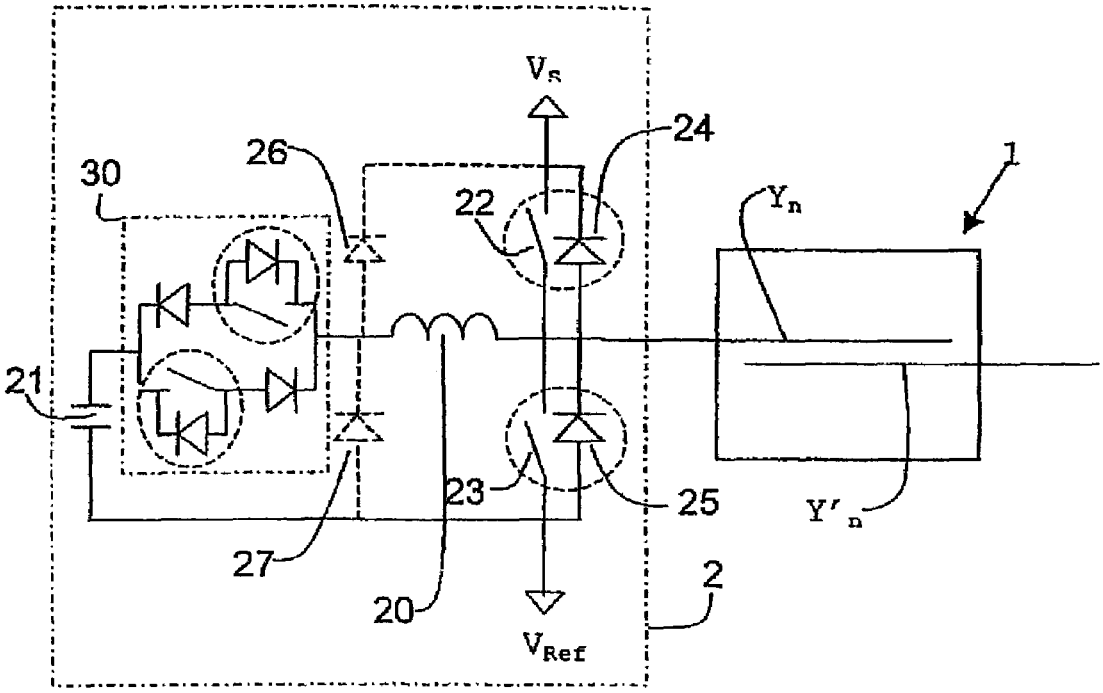
FIG. 2 RELATED ART
Figure 3:
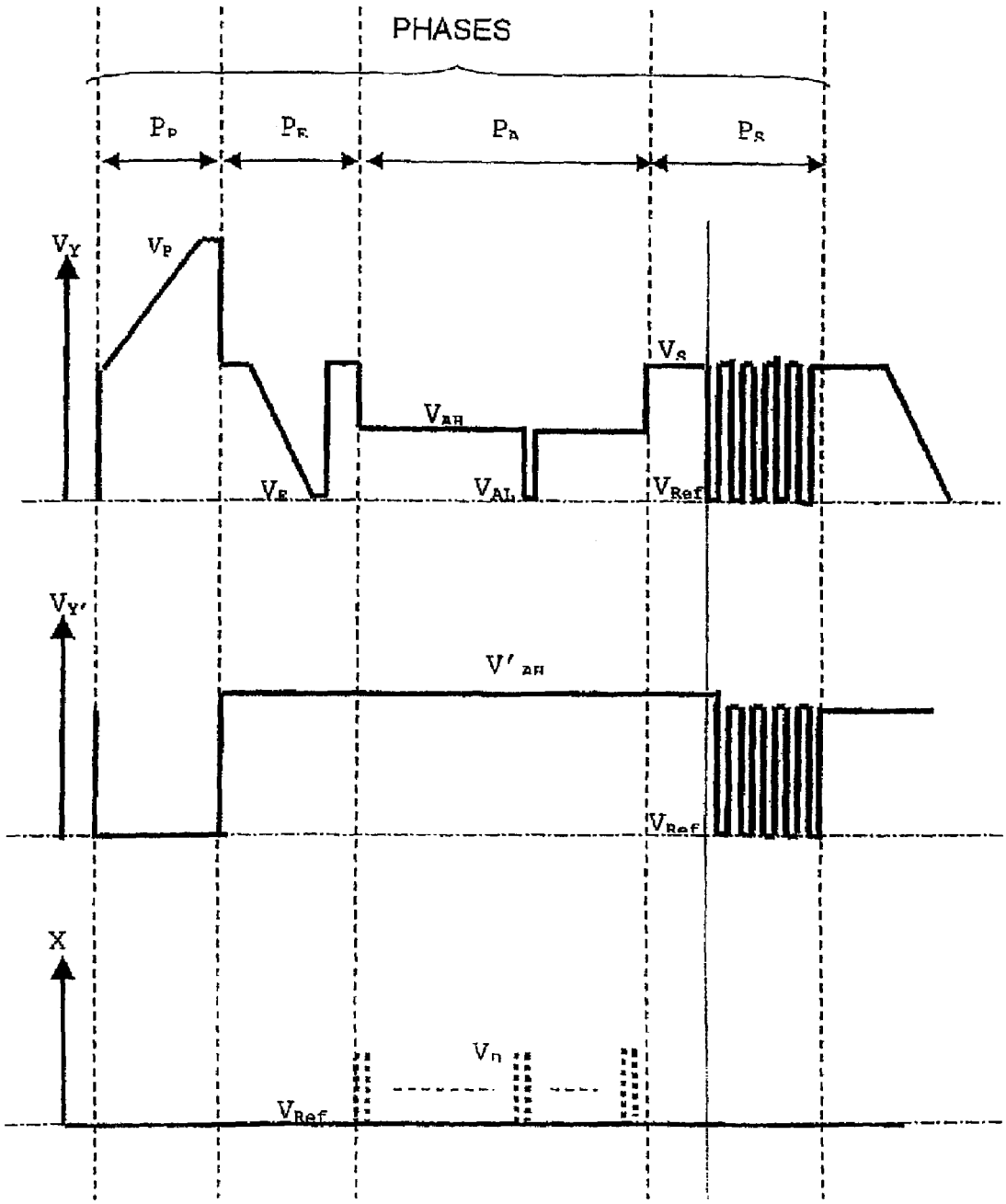
FIG. 3 RELATED ART
FIG. 3, already described, illustrates the timing diagrams for voltage applied to the electrodes of a plasma panel according to a conventional drive scheme that does not include phases in which the applied voltages are negative.
Figure 4:
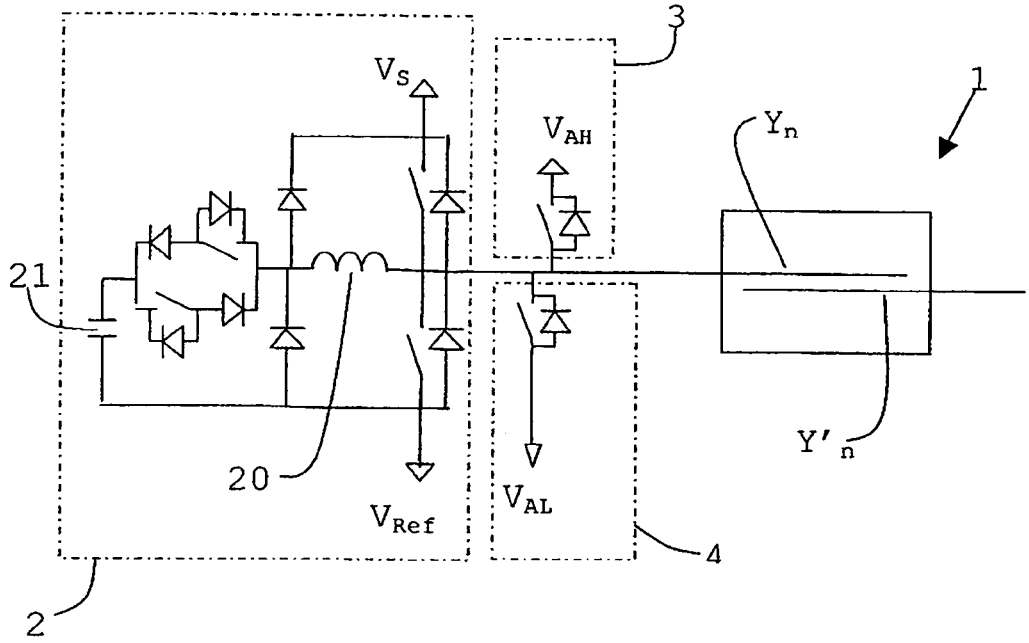
FIG. 4, already described, illustrates diagrammatically the supply for an electrode used for the address phase and the sustain phase, by means of a device according to the prior art.
Figure 5:
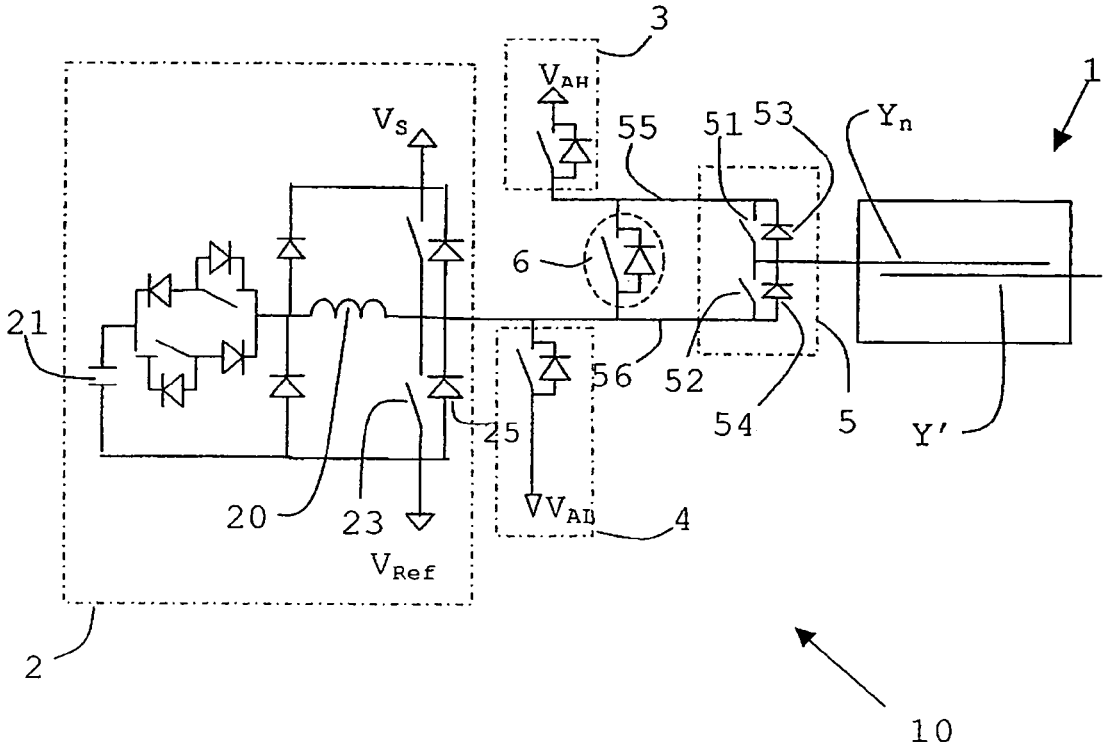
FIGS. 5 and 6, already described, illustrate diagrammatically the supply for an array of electrodes used for the address phase and the sustain phase, by means of a device according to the prior art using two different types of driver.
Figure 9:
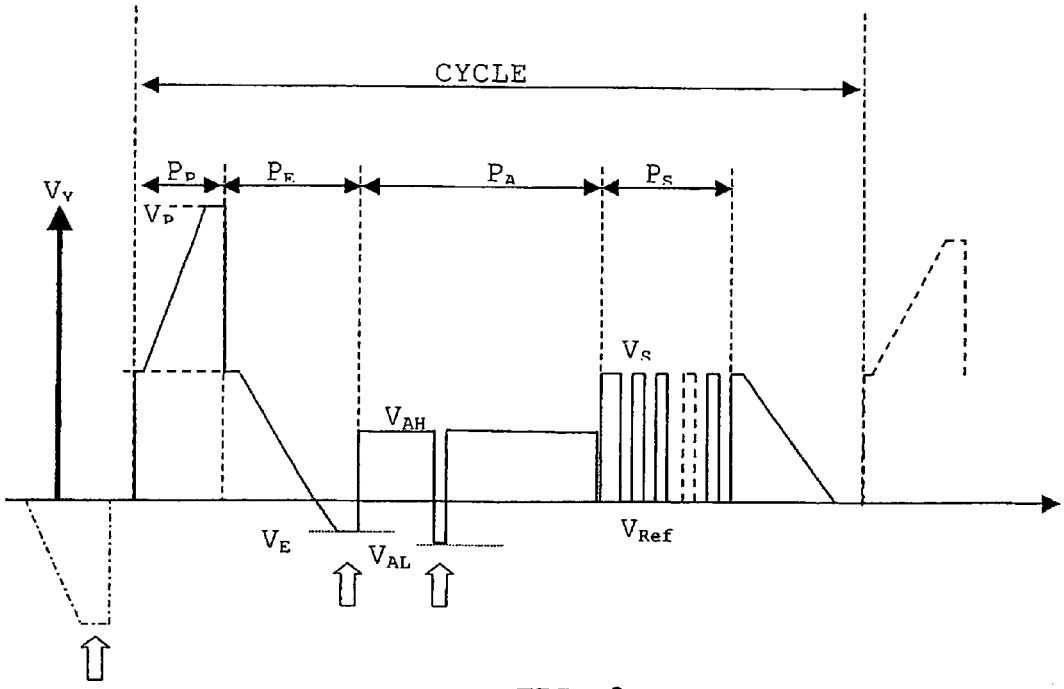
FIG. 9, already described, illustrates the timing diagram for the voltage applied to the sustain and address electrodes of a plasma panel according to a drive scheme that includes phases in which the applied voltages are negative.
Figure 10:
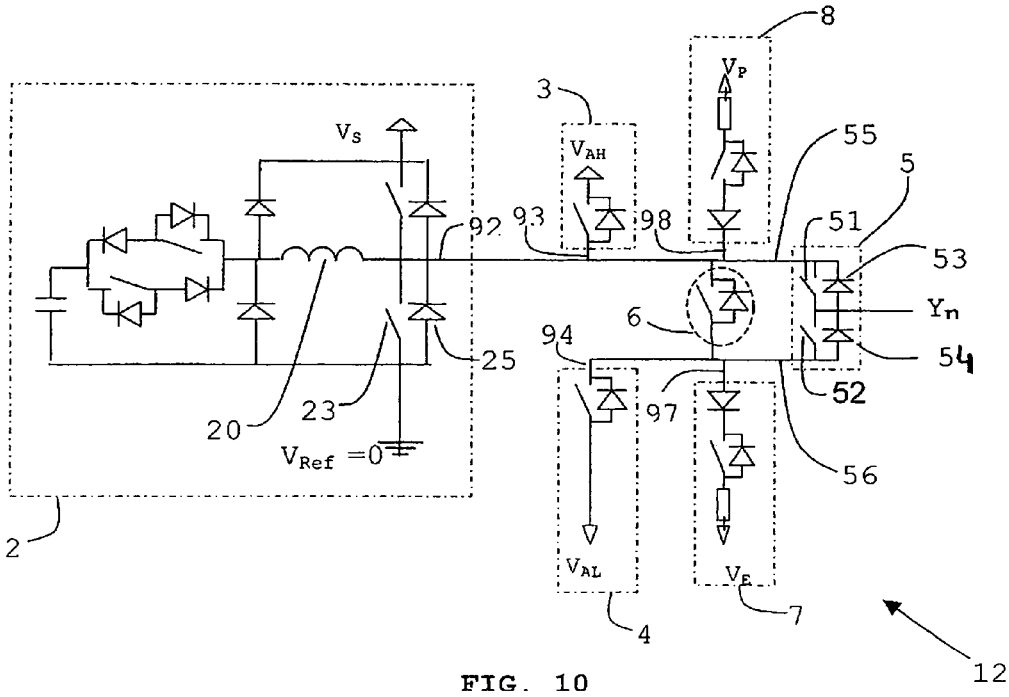
FIGS. 10 and 11 illustrate diagrammatically the supply for an array of electrodes used for the address phase and the sustain phase, by means of a device according to two embodiments of the invention that differ by the type of driver used, but both being provided with the sustain generator of FIG. 2.

Referring to FIGS. 9 and 10, the device 12 for supplying the second array Y of electrodes comprises, according to a first embodiment of the invention:

- a conventional priming voltage ramp generator 8 capable of delivering a ramp up to a positive voltage hold $V_P$, corresponding to the phase $P_P$ of the timing diagram shown in FIG. 9, between a reference terminal (not shown) and an output supply terminal 98;
- a conventional erase voltage ramp generator 7 capable of delivering a ramp down to a negative voltage hold $V_E$, corresponding to the phase $P_E$ of the timing diagram shown in FIG. 9, between a reference terminal (not shown) and an output supply terminal 97;
- a conventional address bias voltage generator 3, already described, capable of delivering a positive voltage $V_{AH}$, corresponding to the phase $P_A$ of the timing diagram shown in FIG. 9, between a reference terminal (not shown) and an output supply terminal 93;
- a conventional address voltage generator 4, already described, capable of delivering a negative voltage $V_{AL}$, corresponding to an address sequence for an electrode $Y_n$ of the array Y during the phase $P_A$ of the timing diagram shown in FIG. 9, between a reference terminal (not shown) and an output supply terminal 94;
- a conventional sustain pulse generator 2, already described with reference to FIG. 2, comprising a capacitive-energy recovery module of the "Weber" type by means of a resonant inductor 20 and capable of delivering a series of pulses of voltage $V_S$, corresponding to the phase $P_S$ of the timing diagram shown in FIG. 9, between a reference terminal at the reference potential $V_{ref}$ and an output supply terminal 92; and
- for each electrode $Y_n$ of the array Y, a conventional driver 5, described above with reference to FIG. 5, comprising two diodes 53, 54 in series, both being conducting from what is called the lower part to what is called the upper part of the series, and two switches 51, 52 in series, the common points of which are connected together and connected to this electrode $Y_n$, the outermost terminals of which, on the upper side on the one hand and on the lower side on the other, are connected together and form an upper terminal and a lower terminal, respectively.

The upper input terminals of all the drivers 5 are connected together in order to form a common upper terminal 55; the lower input terminals of all the drivers 5 are connected together in order to form a common lower terminal 56.

The priming voltage ramp generator 8 and the address bias voltage generator 3 are positive voltage generators.

The erase voltage ramp generator 7 and the address voltage generator 4 are negative voltage generators.

The conventional sustain generator includes a diode 25 connected so as to be conducting between the reference terminal and the output supply terminal 92; there is no switch in series with this diode between this reference terminal and the supply terminal 92.

All the output supply terminals 93, 98 of the positive voltage generators are connected together and to the upper input terminal 55 of the drivers; all the output supply terminals 94, 97 of the negative voltage generators are connected together and to the lower input terminal 56 of the drivers.

All the reference voltages are connected and are at the same potential $V_{ref}$.

According to the invention:

- the supply device for the second array Y of electrodes includes a power switch 6 between the common upper input terminal 55 of the drivers and their common lower input terminal 56;
- the output supply terminal 92 of the sustain generator 2 is connected directly and without an intermediate switch to the common upper terminal 55 of the drivers.

Thus connected, the electrodes $Y_n$ supplied by the device according to the invention may be used both as address electrodes in relation to the data column electrodes of the first array X and as coplanar sustain electrodes in relation to the "common" line electrodes of the third array Y'.

Since the output 92 of the sustain generator and the power switch 6 are thus connected according to the invention, it is then advantageous to use the power switch 6 to isolate the sustain generator 2 from the negative voltage generators 4, 7 during the time periods when these negative voltage generators are applying a negative voltage below the reference voltage $V_{ref}$ to at least one electrode of the array Y via its driver 5.

Moreover, in a conventional manner described above, this switch remains closed during the sustain phases $P_S$; in contrast, when a control voltage, that is to say a voltage other than the sustain voltage, is applied to at least one of the line drivers, especially during at least part of the other phases $P_P$, $P_E$, $P_A$, this switch remains open.

Thus, without adding any component to electrical supply devices of the prior art, rather by adapting the structure and the connections of their components, it is possible to prevent the short-circuit via the diode 25 of the sustain generator during phases when the voltage applied to electrodes $Y_n$ supplied by the device according to the invention reaches a value below the reference voltage $V_{ref}$.

The panel drive means are also designed to open the power switch 6 at least during these negative voltage application phases.

During the operation of the image display device thus obtained, to display a succession of images forming a video sequence:

each image is divided into a two-dimensional matrix of pixels and each pixel into sub-pixels, each corresponding to one of the primary colours, so that each sub-pixel corresponds to one cell of the panel;

the intensity of each sub-pixel is distributed over a pre-established set of sub-scans characterized by a given grey level;

a succession of scans corresponding to the succession of images, and a succession of sub-scans for each image, are generated; for each sub-scan, a voltage corresponding to the timing diagram shown in FIG. 9 is applied to the electrodes $Y_n$ of the sustain and address array Y using the drive means and the supply device according to the invention:

during a first phase called the priming phase $P_P$, a positive voltage is applied to all the electrodes, then, during a second phase called the erase phase $P_E$, a voltage is applied to all the electrodes, this voltage reaching, during at least part of this phase, a negative value $V_E$ below the reference potential $V_{ref}$, then, during a third phase called the address phase $P_A$, on the one hand a positive voltage $V_{AH}$ is applied simultaneously to all the electrodes and on the other hand a negative voltage $V_{AL}$ is applied in succession to each electrode $Y_n$ of the array Y and then, during a fourth and final phase called the sustain phase, a potential varying periodically between a reference potential $V_{ref}$ and a positive sustain potential $V_S$ is applied to all the electrodes, the number of alternations depending on the grey level specific to the sub-scan.

According to the invention, during the time periods when a negative voltage is applied to at least one electrode of the array Y, the power switch 6 is opened in order to isolate the sustain generator 2 from the negative voltage generators 4, 7.

Thus, it is possible to prevent the short-circuit via the diode 25 of the sustain generator in a simple manner.

According to another known scan or sub-scan method, the initial address step is not selective so that, at the sustain step, all the discharge regions of the panel are activated; a step called a selective erase step is therefore then applied, which makes it possible to keep lit only the discharge regions corresponding to pixels to be activated.

Two non-limiting alternative embodiments of the invention will now be described.

Figure 6:
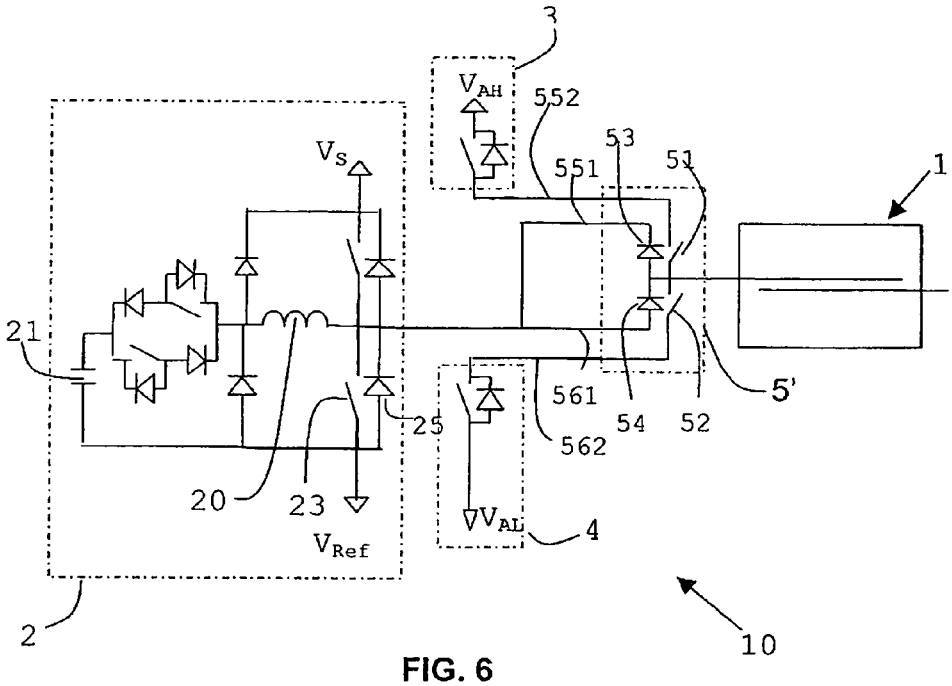

The invention applies to driver types other than those described above; referring to FIG. 11, the electrode supply device according to a second embodiment of the invention comprises components identical to those of the first embodiment, except for the drivers, which in this case correspond to those 5' already described with reference to FIG. 6; each driver for an electrode $Y_n$ comprises:

two driver diodes 53, 54 in series, oriented so as to be conducting in the same direction from one terminal 561 of the series, common to all the drivers, called the "lower power" terminal to the other terminal 552 of the series, also common to all the drivers, called the "upper power" terminal, the common point of these diodes being connected to the electrode $Y_n$ to be supplied; and two driver switches 51, 52 in series, the common point of these switches also being connected to the electrode $Y_n$ to be supplied, the outermost terminals of this series of switches 51, 52 being common to all the drivers, one terminal called the "lower switched" terminal 561 being connected directly to the supply terminals 94, 97 of the negative voltage generators 4, 7 (the generator 7 and the terminal 97 are not shown) and the other terminal called the "upper switched" terminal 562 being connected directly to the supply terminals 93, 98 of the positive voltage generators 3, 8 (the generator 8 and the terminal 98 are not shown).

Unlike the drivers 5 described above, the outermost terminals of the series of diodes and of switches are not connected together, either on the upper side or on the lower side; the invention also covers the intermediate case in which the outermost terminals are connected only on one side—either the lower side or the upper side.

As previously, all the reference terminals are connected and at the same potential $V_{ref}$.

According to the invention:

the device for supplying the second array Y of electrodes includes a power switch 6 between the common upper power terminal 551 of the drivers 5' and their common lower power terminal 561; and the output power terminal 92 of the sustain generator 2 is connected directly and without an intermediate switch to the common upper power terminal 551 of the drivers 5'.

Since the output 92 of the sustain generator and the power switch 6 are thus connected according to the invention, it is then possible to use, as previously, the power switch 6 to isolate the sustain generator 2 from the negative voltage generators 4, 7 during the time periods when these negative voltage generators are applying a negative voltage below the reference voltage $V_{ref}$ to at least one electrode of the array Y via the lower switch 52 of its driver 5' (which must then be closed); it is thus possible to prevent the short-circuit via the diode 25 of the sustain generator and via the lower diode 54 of this driver during these negative voltage application periods, provided, of course, that the power switch 6 remains open during these periods.

Figure 1:
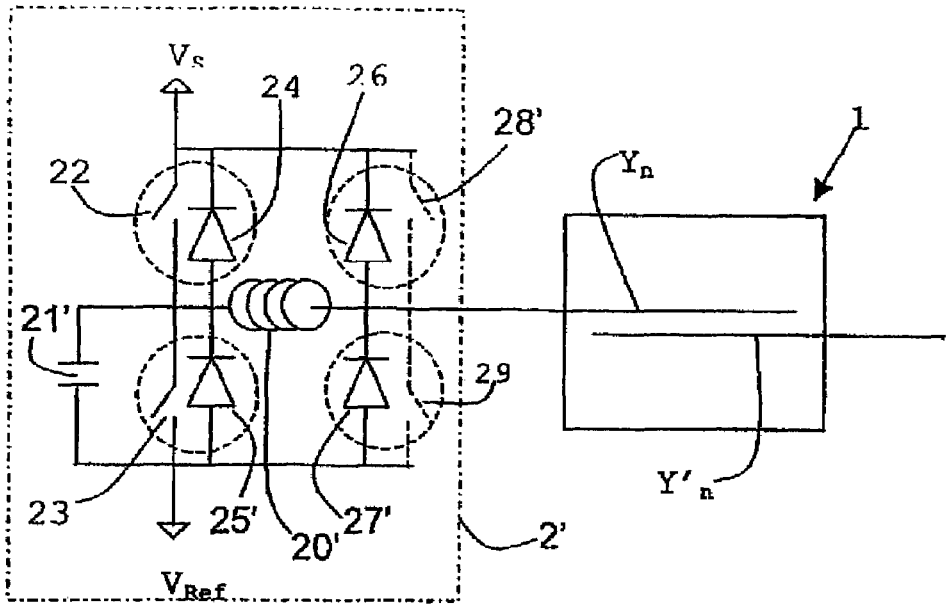
FIG. 1 RELATED ART
FIGS. 1 and 2, already described, illustrate two conventional sustain generators provided with a resonant inductor for energy recovery.

The invention applies to other types of sustain generator than those described above; with reference to FIG. 12, the electrode supply device 12" according to a third embodiment of the invention comprises identical components connected together as in the first embodiment, except that the sustain generator 2', which was already described with reference to FIG. 1, here comprises a capacitive-energy recovery module, in this case of the Higgins type, by means of a resonant inductor 20'; this generator is also capable of delivering a series of pulses of voltage $V_S$, corresponding to the phase $P_S$ of the timing diagram shown in FIG. 9, between a reference terminal at the reference potential $V_{ref}$ and an output supply terminal 92.

Again, thanks to the power switch 6 according to the invention and to the connections of the components of the supply device according to the invention, it is possible to prevent the short-circuit via the diode 27' of the sustain generator 2' during phases when the voltage applied to electrodes $Y_n$ supplied by the device according to the invention reaches a value below the reference value $V_{ref}$.

Figure 11:
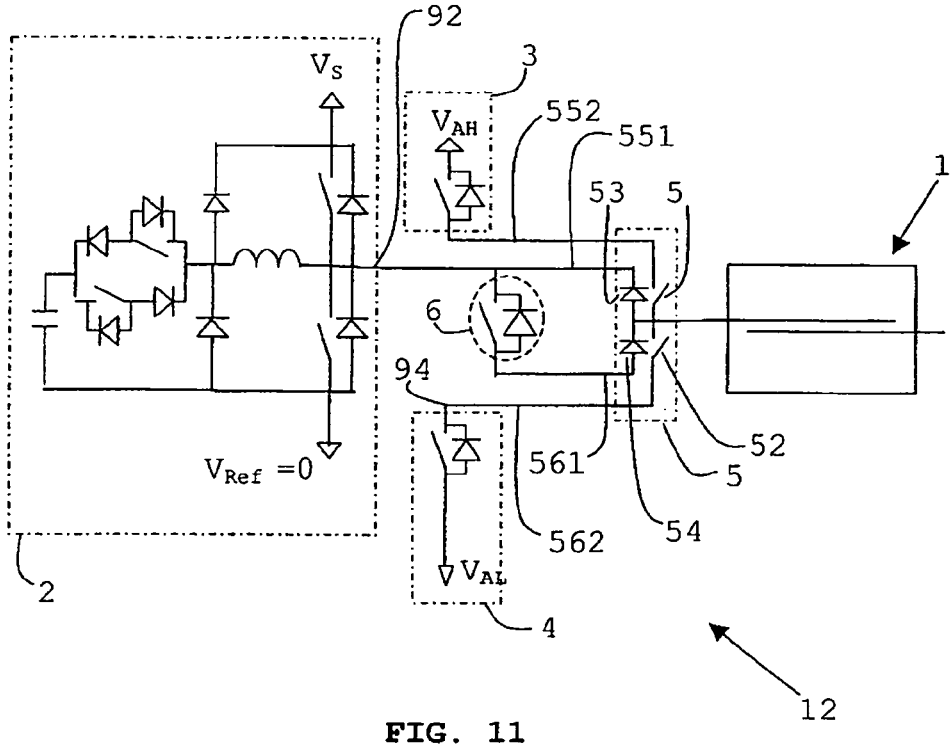
Figure 12:
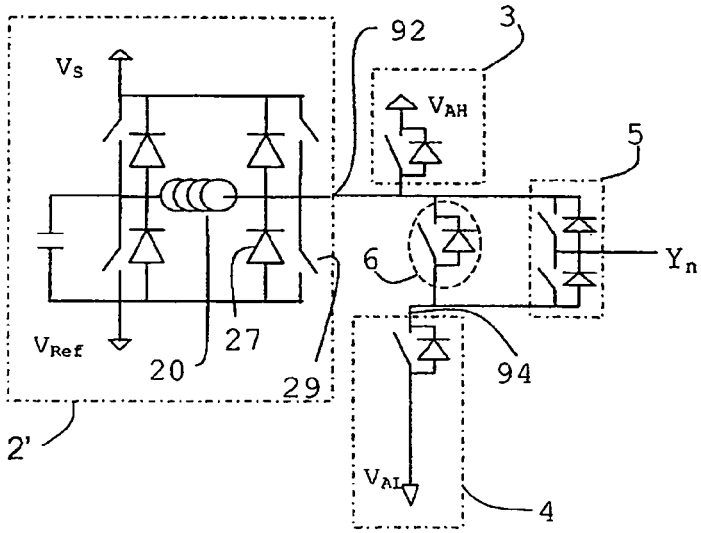
FIG. 12 illustrates another electrode supply device according to the invention, differing mainly from the device of FIG. 10 in that it is provided with a sustain generator of FIG. 1.

In FIG. 12, as in FIG. 11, the erase generator 7 and the priming generator 8 are not shown for the sake of simplicity.

The way in which the sustain generator is connected according to the invention to the drivers of the electrode supply device and the use according to the invention of the power switch to isolate the sustain generator from the negative voltage generators during the periods when one of these generators is applying a negative voltage to one or more of these electrodes via their driver are applicable to sustain generators and to drivers other than those described above.

The invention claimed is:

1. A supply device for supplying an array of electrodes of a plasma display panel provided with a two-dimensional matrix of discharge cells, the supply device comprising:

a sustain pulse generator which generates, between a reference terminal and at least one supply terminal that can be connected to the electrodes, positive sustain pulses, the sustain pulse generator being provided with a module for recovering or re-injecting, using a resonant inductor, capacitive energy at the rising or falling edges of said positive sustain pulses, wherein the sustain pulse generator allows electrical current to flow between the reference terminal and the supply terminal of the sustain pulse generator when a negative voltage is applied between the supply terminal and the reference terminal;

at least one negative voltage generator which generates a negative voltage between the reference terminal and a second supply terminal that can be connected to the electrodes;

for each electrode of the array, a driver which connects, on command, the supply terminal of the sustain pulse generator and/or the second supply terminal of the at least one negative voltage generator to the electrode, the driver comprising:

two driver diodes in series, oriented so as to be conducting in the same direction from a low power terminal of the series, common to all the drivers, to an upper power terminal of the series, common to all the drivers, a common point of the driver diodes being connected to the electrode; and two driver switches in series, a common point of the driver switches being connected to the electrode, outermost terminals of the driver switches being common to all the drivers and including an upper switched terminal and a lower switched terminal, the lower switched terminal being connected directly to the second supply terminal of the negative voltage generator, wherein the supply device further comprises a power switch between the upper power terminal of the drivers and the lower power terminal, and wherein the supply terminal of the sustain pulse generator is connected directly and without an intermediate switch to the upper power terminal of the drivers.

2. The supply device according to claim 1, wherein the sustain pulse generator comprises a diode which is connected so as to be conducting between the reference terminal and the supply terminal of the sustain pulse generator, without a switch in series with the diode between the reference terminal and the supply terminal.

3. The supply device according claim 2, further comprising at least one positive voltage pulse generator which generates a positive voltage between the reference terminal and a third supply terminal which is connected to the upper switched terminal of the driver switches.

4. The supply device according to claim 2, wherein the electrodes of the array are used for addressing the cells of the plasma display panel.

5. The supply device according to claim 1, further comprising at least one positive voltage pulse generator which generates a positive voltage between the reference terminal and a third supply terminal which is connected to the upper switched terminal of the driver switches.

6. The supply device according to claim 5, wherein the electrodes of the array are used for addressing the cells of the plasma display panel.

7. The supply device according to claim 1, wherein the electrodes of the array are used for addressing the cells of the plasma display panel.

8. The supply device according to claim 1, wherein the upper power terminal is connected to and coincident with the upper switched terminal and the lower power terminal is connected to and coincident with the lower switched terminal.

9. An image display device comprising a plasma panel, the plasma panel comprising two plates having a space therebetween, the space containing a discharge gas and being partitioned into cells forming a two-dimensional array, the two-dimensional array comprising at least a first array of electrodes and a second array of electrodes, each electrode of the first array intersecting each electrode of the second array at a different cell of the plasma panel, wherein the image display device includes supply device according claim 1, and the common point of the driver diodes and the common point of the driver switches of each of the drivers of the supply device are connected to a different electrode of one of the first array of electrodes and the second array of electrodes.

10. The image display device according to claim 9, wherein the plasma panel includes a third array of electrodes that are designed to form, with each of the electrodes supplied by the supply device, pairs of parallel electrodes for sustaining plasma discharges in the cells.

11. The image display device according to claim 10, further comprising controlling means for controlling the plasma discharges in the cells of the plasma panel, the controlling means being designed to generate, using the supply device, selective address phases by depositing electrical charges in pre-selected cells and non-selective sustain phases designed to cause discharges only in the pre-selected cells, wherein the electrodes supplied by the supply device are address electrodes and sustain electrodes.

12. The image display device according to claim 11, wherein the controlling means are designed:

to generate, using the at least one negative voltage generator of the supply device, phases during which voltage applied to the electrodes supplied by the supply device reaches a value below a reference voltage of the reference terminal; and to open the power switch during the phases.

13. A method of driving the display device according to claim 12, in order to display images, the method comprising:

performing a succession of image scans and sub-scans, each sub-scan comprising:

a sustain phase, during which a potential varying periodically between a reference potential and a positive sustain potential is applied to the electrodes supplied by the supply device; and at least one preliminary phase during which a negative potential below the reference potential is applied to the electrodes, wherein the power switch is open when the negative potential is applied.

14. A method of driving the display device according to claim 11, in order to display images, the method comprising:

performing a succession of image scans and sub-scans, each sub-scan comprising:

a sustain phase, during which a potential varying periodically between a reference potential and a positive sustain potential is applied to the electrodes supplied by the supply device; and at least one preliminary phase during which a negative potential below the reference potential is applied to the electrodes, wherein the power switch is open when the negative potential is applied.

15. The image display device according to claim 10, further comprising controlling means for controlling the plasma discharges in the cells of the plasma panel, the controlling means being designed to generate, using the supply device, selective address phases by depositing electrical charges in pre-selected cells and non-selective sustain phases designed to cause discharges only in the pre-selected cells, wherein the electrodes supplied by the said supply device are sustain electrodes.

16. The image display device according to claim 15, wherein the controlling means are designed;

to generate, using the at least one negative voltage generator of the supply device, phases during which voltage applied to the electrodes supplied by the said supply device reaches a value below a reference voltage of the reference terminal; and to open the power switch during the phases.

17. A method of driving the display device according to claim 15, in order to display images, the method comprising:

performing a succession of image scans and sub-scans, each sub-scan comprising:

a sustain phase, during which a potential varying periodically between a reference potential and a positive sustain potential is applied to the electrodes supplied by the supply device; and at least one preliminary phase during which a negative potential below the reference potential is applied to the electrodes, wherein the power switch is open when the negative potential is applied.

18. A method of driving the display device according to claim 10, in order to display images, the method comprising:

performing a succession of image scans and sub-scans, each sub-scan comprising:

a sustain phase, during which a potential varying periodically between a reference potential and a positive sustain potential is applied to the electrodes supplied by the supply device; and at least one preliminary phase during which a negative potential below the reference potential is applied to the electrodes, wherein the power switch is open when the negative potential is applied.

19. A method of driving the display device according to claim 9, in order to display images, the method comprising:

performing a succession of image scans and sub-scans, each sub-scan comprising:

a sustain phase, during which a potential varying periodically between a reference potential and a positive sustain potential is applied to the electrodes supplied by the supply device; and at least one preliminary phase during which a negative potential below the reference potential is applied to the electrodes, wherein the power switch is open when the negative potential is applied.

20. The drive method according to claim 19, wherein at least one lower switch of the drivers is closed when the negative potential is applied.

* * * * *